US006709709B1

(12) United States Patent
Ozawa et al.

(10) Patent No.: US 6,709,709 B1
(45) Date of Patent: Mar. 23, 2004

(54) DEODORIZING FIBERS AND PROCESS FOR PRODUCING THE SAME

(75) Inventors: Nanami Ozawa, Miyazu (JP); Shingo Akieda, Miyazu (JP); Hisashi Mukai, Miyazu (JP)

(73) Assignee: Gunze Limited, Kyoto (JP)

( * ) Notice: Subject to any disclaimer, the term of this patent is extended or adjusted under 35 U.S.C. 154(b) by 0 days.

(21) Appl. No.: 09/913,119

(22) PCT Filed: Feb. 8, 2000

(86) PCT No.: PCT/JP00/00685

§ 371 (c)(1),
(2), (4) Date: Aug. 7, 2001

(87) PCT Pub. No.: WO00/46441

PCT Pub. Date: Aug. 10, 2000

(30) Foreign Application Priority Data

Feb. 8, 1999 (JP) ..... 11-70699

(51) Int. Cl.[7] ..... B05D 1/00
(52) U.S. Cl. ..... 427/389.9
(58) Field of Search ..... 427/389.9, 392, 427/393.2, 393.4, 394, 396

(56) References Cited

U.S. PATENT DOCUMENTS 6,252,003 B1 * 6/2001 Kuwahara et al. ..... 525/242

FOREIGN PATENT DOCUMENTS

| | | | |
|---|---|---|---|
| EP | 0 677 989 B1 | | 10/1995 |
| JP | 7-229063 | | 8/1995 |
| JP | 8-13340 | | 1/1996 |
| JP | 08-013340 | | 1/1996 |
| JP | 8-113874 | | 5/1996 |
| JP | 08-113874 | | 5/1996 |
| JP | 08-246349 | * | 9/1996 |
| JP | 09-049169 | * | 2/1997 |
| JP | 2000-080569 | * | 3/2000 |
| JP | 2002-102321 | * | 4/2002 |
| WO | WO 94/15462 | | 7/1994 |

OTHER PUBLICATIONS

Hasebe et al, Proceedings of the Annual Int. Conf. and Exh. of the AATCC, pp 242–243, 2000.*

* cited by examiner

*Primary Examiner*—Erma Cameron
(74) *Attorney, Agent, or Firm*—Knobbe, Martens, Olson & Bear LLP

(57) ABSTRACT

The present invention relates to deodorizing fibers that especially effectively deodorize body odors such as sweat odor and have improved launderability (durability), and a process for producing the same. The object of the invention is to provide a process for producing deodorizing fibers by imparting excellent deodorizing property and improved launderability (durability) to natural fibers or synthetic fibers, or textiles such as underwear formed by weaving or knitting yarns therefrom.

The process for producing deodorizing fibers according to the present invention comprises treating fibers with a treating liquid containing chitosan and/or a modified chitosan, a carboxylic acid polymer, zinc oxide and a binder resin. The deodorizing fibers of the present invention have a coating layer of a waterproof binder resin comprising chitosan and/or a modified chitosan, a carboxylic acid polymer and zinc oxide.

6 Claims, 2 Drawing Sheets

DEODORIZING FIBERS AND PROCESS FOR PRODUCING THE SAME

This application is the National Phase of PCT Application No. PCT/JP00/00685, filed Feb. 8, 2000.

TECHNICAL FIELD

The present invention relates to deodorizing fibers that especially effectively deodorize body odors such as sweat odor and have improved launderability (durability), and to a process for producing the same.

BACKGROUND ART

Body odors such as sweat odor give discomfort to people around the person and cause much trouble. The components of sweat as they are do not emit a heavy odor but are converted to lower carboxylic acids or volatile substances by the action of bacteria which exist on the skin, and give off an offensive odor. Known as body odor components are various substances, for example, acetic acid, butyric acid, propionic acid, isovaleric acid, caproic acid and like lower carboxylic acids, steroids, etc.

To suppress body odors, clothing having deodorizing function is commercially available. However, the conventional clothing is not fully satisfactory in deodorizing capability and in prolonged effect (durability).

In view of the above state, the present invention was made. The object of the invention is to provide deodorizing fibers by imparting excellent deodorizing property and improved launderability (durability) to natural fibers or synthetic fibers, or textiles formed by weaving or knitting yarns therefrom, particularly underwear or like cloths; and provide a process for producing the same.

DISCLOSURE OF INVENTION

Figure 1:
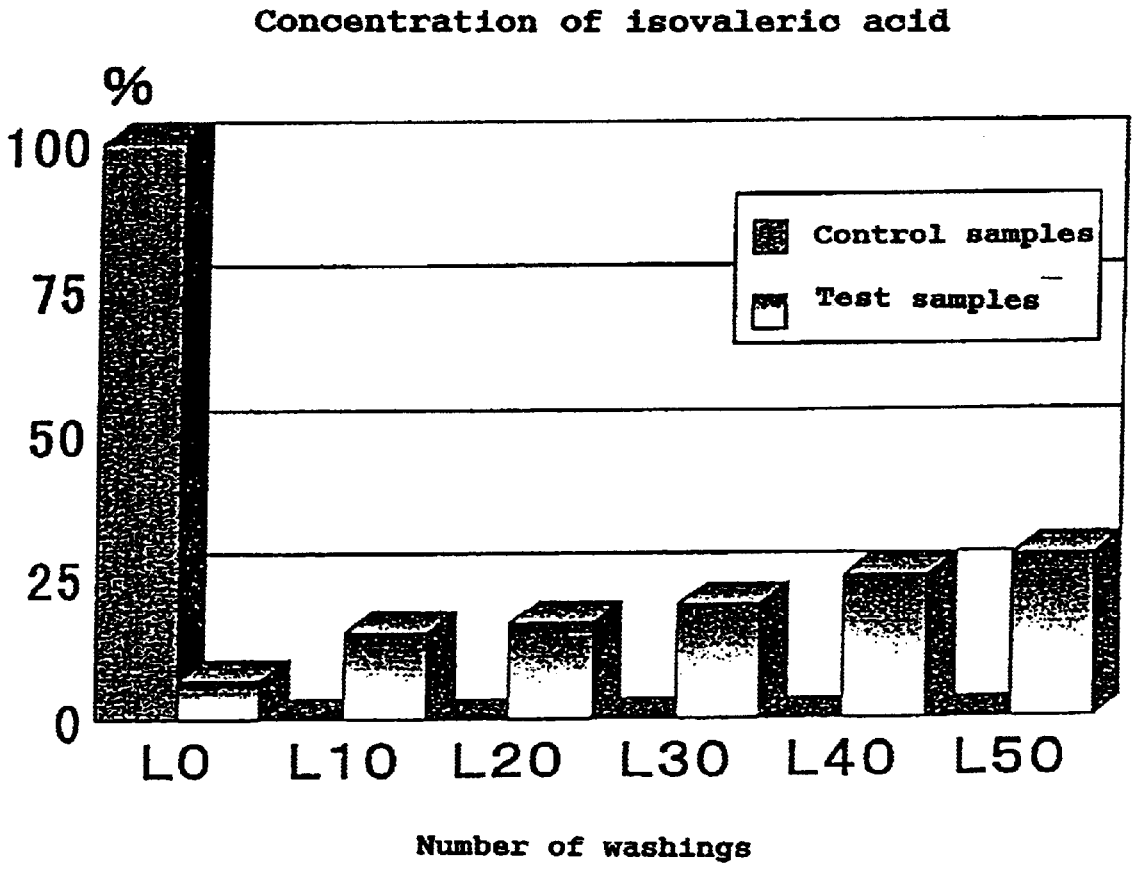
FIG. 1 is a graph comparing the concentrations of isovaleric acid.

The present invention concerns the following items 1–5.

Item 1 A process for producing deodorizing fibers, comprising treating fibers with a treating liquid comprising chitosan and/or a modified chitosan, a carboxylic acid polymer, zinc oxide and a binder resin.

Item 2 The process for producing deodorizing fibers according to item 1, comprising treating the fibers using a softening agent together with the treating liquid.

Item 3 The process for producing deodorizing fibers according to item 1, wherein the fibers are natural fibers or synthetic fibers, or textiles formed by weaving or knitting yarns therefrom.

Item 4 The process for producing deodorizing fibers according to item 1, wherein the binder resin is at least one aqueous emulsion selected from the group consisting of acrylic resins, methacrylic resins, urethane resins, silicon resins, glyoxal resins, vinyl acetate resins, vinylidene chloride resins, butadiene resins, melamine resins, epoxy resins, acrylic-silicon copolymer resins, ethylene-vinyl acetate copolymer resins and isobutylene-maleic anhydride copolymer resins.

Item 5 A deodorizing fiber having a coating layer of a waterproof binder resin comprising chitosan and/or a modified chitosan, a carboxylic acid polymer and zinc oxide.

Chitosan can be obtained by deacetylating chitin contained in the crusts of crustaceans such as shrimps, crabs and insects. Examples of modified chitosans are hydroxypropyl chitosan, hydroxypropyl methyl chitosan, hydroxymethyl chitosan, methyl chitosan and carboxymethyl chitosan. The chitosan and modified chitosans may be used singly or in combination. A combined use of chitosan and at least one modified chitosan produces higher deodorizing effects than a single use thereof.

The chitosan and modified chitosans are preferably fine particles having an average particle diameter of 0.01–10 $\mu$m, preferably 0.1–10 $\mu$m, more preferably 1–10 $\mu$m. The average particle diameter is measured using a laser diffraction-type particle diameter distribution measuring apparatus (LA-100 manufactured by Horiba, Ltd.). The method for producing fine particles of chitosan or modified chitosans includes, for example, a method comprising adding an acidic aqueous solution of chitosan or a modified chitosan dropwise to an alkaline aqueous solution using a nozzle, a method comprising spraying an acidic aqueous solution of chitosan or a modified chitosan at high temperatures, and a method (emulsification method) comprising the steps of mixing an acidic aqueous solution of chitosan or a modified chitosan with a hydrophobic solvent, emulsifying the mixture to form an emulsion, and injecting the emulsion into a base or organic solvent to solidify the emulsion. The fine particles of chitosan and modified chitosans have a surface area of 10–300 $m^2/g$, preferably 30–300 $m^2/g$, more preferably 50–300 $m^2/g$. The specific surface area is measured using a fluid-type specific surface area automatic measuring device (Flow Soap, Model 2300, manufactured by Shimazu Seisaku-sho). The chitosan or modified chitosans preferably have a weight average molecular weight of $1\times10^3$ to $1\times10^6$. The weight average molecular weight is measured by GPC (gel permeation chromatography) using 0.5M acetate buffer (0.5M acetic acid+0.5M sodium acetate) as an eluate and using an aqueous column. It is preferable that chitosan have a deacetylation degree of 80% or more. A total amount of chitosan and modified chitosan(s) in the treating liquid is 0.1 to 1.0 wt. %, preferably 0.3 to 0.8 wt. %, more preferably 0.4 to 0.6 wt. %.

The treating liquid contains zinc oxide in an amount of 0.1 to 0.6 wt. %, preferably 0.1 to 0.5 wt. %, more preferably 0.1 to 0.4 wt. %.

Examples of carboxylic acid polymers useful in the invention are homopolymers of polyacrylic acid, polymethacrylic acid, polymaleic acid, polyfumaric acid or polyitaconic acid; copolymers of these carboxylic acid-containing monomers (e.g., an acrylic acid-maleic acid copolymer); copolymers of a carboxylic acid-containing monomer and another monomer (ethylene, propylene, stylene. etc.)(e.g., a stylene-maleic acid copolymer); and acidic cellulose derivatives modified with a polycarboxylic acid (citric acid, tartaric acid, malic acid, oxalic acid, malonic acid, succinic acid, etc.). The carboxylic acid polymer may be used in the form of a salt (e.g., a sodium salt).

The treating liquid contains a carboxylic acid polymer in an amount of 0.1 to 1.0 wt. %, preferably 0.3 to 0.8 wt. %, more preferably 0.4 to 0.6 wt. %.

Any binder resin can be used provided that it is waterproof. Examples of useful binder resins are acrylic resins (acrylic resin oligomers, monofunctional or polyfunctional acrylic resin monomers), methacrylic resins, urethane resins, silicon resins, glyoxal resins, vinyl acetate resins, vinylidene chloride resins, butadiene resins, melamine resins, epoxy resins, acrylic-silicon copolymer resins, ethylene-vinyl acetate copolymer resins, isobutylene-maleic anhydride copolymer resins, ethylene-vinyl acetate copolymer resins, acrylic-silicon copolymer resins, modified ethylene-vinyl acetate copolymer resins, cumarone resins, vinyl propionate resins, methoxymethylated polyamide resins, ethylene-styrene-acrylate-methacrylate resins and like aqueous emulsions. These binder resins can be used singly or in combination of two or more. The resins may further contain a crosslinking agent in an amount of about 0.05 to 2 wt. %.

The treating liquid contains one or more binder resins (solid content of the aqueous emulsion) in an amount of 0.1 to 1.0 wt.*, preferably 0.1 to 0.8 wt. %, more preferably 0.2 to 0.5 wt. %.

Fibers to be treated with the treating liquid of the invention are, for example, natural fibers (cotton, hemp, silk, wool, feather, etc.), synthetic fibers (polyester, acrylic, polyamide, etc.), or mixtures thereof. The fibers may be in any form such as threads, woven fabrics, knittings, non-woven fabrics, etc.

The treating liquid of the invention preferably contains a dispersing agent such as polyoxyethylene alkyl ether and an antiperspirant such as allantoinchlorohydroxy aluminum.

The deodorizing fibers of the invention preferably have an coating layer about 0.5 to 10 $\mu$m in thickness. The coating layer is formed in an amount of about 0.1 to 0.7 parts by weight per 100 parts by weight of the fibers. The proportions of the chitosan and/or modified chitosan, carboxylic acid polymer, zinc oxide and water-proof binder resin (based on solid content) in the coating layer are the same as in the treating liquid.

According to the present invention, natural fibers or synthetic fibers, or textiles for underwear or the like formed by weaving or knitting these threads are treated with a treating liquid comprising chitosan and/or a modified chitosan, a carboxylic acid polymer, zinc oxide and a binder resin to thereby inhibit the propagation of normal bacteria attached to the textiles and make odorants adsorbed on the textiles, thus exhibiting deodorizing effects.

Further, use of a softening agent together with the treating liquid, particularly treatment in the same bath, achieves efficient processing.

BEST MODE FOR CARRYING OUT THE INVENTION

The present invention will be described below in more detail with reference to examples. However, the invention is not limited to these examples.

EXAMPLE 1

A bleached cotton cloth for underwear obtained by the conventional method was subjected to padding treatment at normal temperatures for 1 to 2 seconds (pickup rate 100%) using a treating liquid containing the following components (a) to (c) (pH 7.5 to 8.5) to provide a cotton cloth for underwear according to the method of the present invention.

Treating liquid:

(a) DOR-GZ (15 g/L) of Daiwa Chemical Industry Co. Ltd. (15 g/L; an aqueous emulsion containing 12% zinc oxide, 20% silicon binder resin, 4% hydroxypropyl chitosan and 1% allantoinchlorohydroxy aluminum and 3% polyoxyethylene alkyl ether);

(b) a liquid mixture (40 g/L) of 80 wt. % water, 10wt. % chitosan, 5 wt. % polyacrylic acid and 5 wt. % polyacrylic acid salt; and (c) a softening agent (10 g/L).

Further, the obtained cloth was cut out and sewn by the conventional method to provide undergarments according to the present invention.

EVALUATION EXAMPLE 1

The undergarments prepared in Example 1 were termed "test samples" and the undergarments before the treatment (no deodorizing treatment) were termed "control samples". A wearing test was carried out to attach sweat to the undergarments, and the concentrations of isovaleric acid and caproic acid on the test samples were measured after laundering 0 time (L0) to 50 times (L50) and compared with the concentrations on the control samples (washing 0 time) calculated as 100%.

Stated more specifically, ten subjects wore test samples and control samples alternately each day for a total of 102 days (each sample being worn for 51 days and washed 50 times). Each undergarment was washed after being worn for 1 day. The sweat-attached underwear garments that had been laundered 0, 10, 20, 30, 40 or 50 times and worn for 1 day were placed in a predetermined container, and the concentrations of isovaleric acid and caproic acid in the container were measured by gas chromatography.

Figure 2:
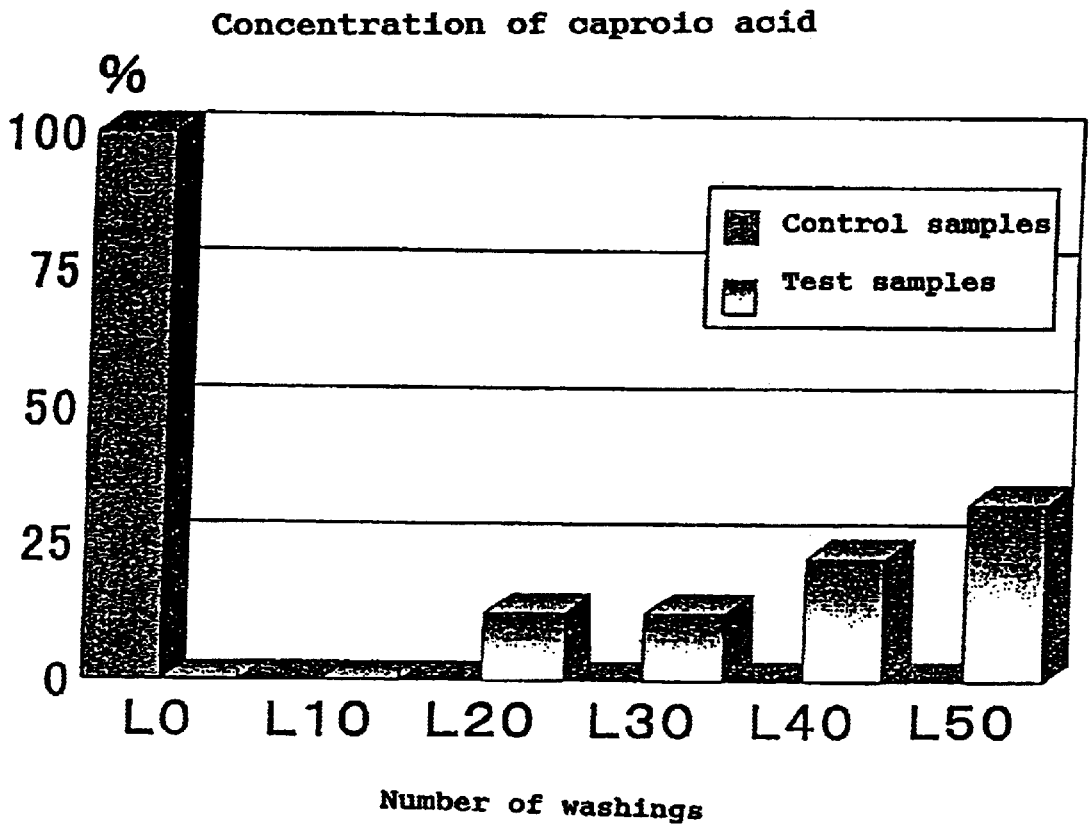
FIG. 2 is a graph comparing the concentrations of caproic acid.

FIGS. 1 and 2 clearly show that the cotton cloth for underwear obtained according to the present invention has high deodorizing effects and improved launderability.

As described above, the present invention provides deodorizing fibers having excellent deodorizing effects and improved launderability.

What is claimed is:

1. A process for producing deodorizing fibers, comprising treating fibers with an aqueous treating liquid comprising 0.1 to 1.0 wt. % of chitosan particles and/or modified chitosan particles, 0.1 to 1.0 wt. % of carboxylic acid polymer, 0.1 to 0.6 wt. % of zinc oxide and 0.1 to 1.0 wt. % of waterproof binder resin.

2. The process for producing deodorizing fibers according to claim 1, comprising treating the fibers using a softening agent together with the treating liquid.

3. The process for producing deodorizing fibers according to claim 1, wherein the fibers are natural fibers or synthetic fibers, or textiles formed by weaving or knitting yarns therefrom.

4. The process for producing deodorizing fibers according to claim 1, wherein the binder resin is in aqueous emulsion form and is at least one resin selected from the group consisting of acrylic resins, methacrylic resins, urethane resins, silicon resins, glyoxal resins, vinyl acetate resins, vinylidene chloride resins, butadiene resins, melamine resins, epoxy resins, acrylic-silicon copolymer resins, ethylene-vinyl acetate copolymer resins and isobutylene-maleic anhydride copolymer resins.

5. The process for producing deodorizing fibers according to claim 1, wherein the chitosan particles and the modified chitosan particles have an average particle diameter of 0.01–10 $\mu$m.

6. The process for producing deodorizing fibers according to claim 1, wherein the chitosan particles and the modified chitosan particles have an average particle diameter of 1–10 $\mu$m.

* * * * *